US008516866B2

(12) United States Patent
Trubert et al.

(10) Patent No.: US 8,516,866 B2
(45) **Date of Patent: *Aug. 27, 2013**

(54) DEVICE AND METHOD FOR EXPLOSIVE FORMING

(75) Inventors: Franz Trubert, Vienna (AT); Alexander Zak, Osterreich (AT); Andreas Stranz, Osterreich (AT)

(73) Assignee: Magna International Inc., Aurora, Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 13/251,475

(22) Filed: Oct. 3, 2011

(65) Prior Publication Data

US 2012/0024029 A1 Feb. 2, 2012

Related U.S. Application Data

(63) Continuation of application No. 11/916,056, filed as application No. PCT/EP2006/003435 on Apr. 13, 2006, now Pat. No. 8,047,036.

(30) Foreign Application Priority Data

Jun. 3, 2005 (DE) ..... 10 2005 025 660

(51) Int. Cl.
*B21J 5/04* (2006.01)

(52) U.S. Cl.
USPC ..... 72/56; 72/730; 72/706

(58) Field of Classification Search
USPC ..... 72/54, 56, 60, 61, 62, 63, 430, 706
See application file for complete search history.

(56) References Cited

U.S. PATENT DOCUMENTS 3,487,668 A * 1/1970 Fuchs, Jr. ..... 72/61
4,738,012 A 4/1988 Hughes et al.

FOREIGN PATENT DOCUMENTS

DE 19638688 A1 3/1998
EP 0 592 068 A1 4/1994

* cited by examiner

*Primary Examiner* — Teresa M Ekiert
(74) *Attorney, Agent, or Firm* — Dickinson Wright PLLC

(57) ABSTRACT

A device for explosive forming of a tubular work piece includes a multipart explosive forming die, which defines a forming area having an inner surface corresponding to a final shape of the tubular work piece and a nozzle arrangement disposed adjacent to the forming area. The device also includes a plug for forming a seal by simultaneously deforming an end of the work piece and clamping the deformed end between the plug and a facing surface of the nozzle arrangement. In this way, the work piece itself contributes to the sealing of an internal explosion space. With insertion of new work piece blanks, and introduction of the plug during each individual forming process, new seals are produced in a convenient manner during subsequent forming processes. The device supports a simplified handling approach and integrates several functions into one working step, resulting in a shorter cycle times and cost-effective industrial production.

11 Claims, 5 Drawing Sheets

DEVICE AND METHOD FOR EXPLOSIVE FORMING

CROSS-REFERENCE TO RELATED APPLICATIONS

This is a Continuation Patent Application which claims the benefit of U.S. patent application Ser. No. 11/916,056 filed Dec. 20, 2007 now U.S. Pat. No. 8,047,036 entitled "Device And Method For Explosion Forming" which claims the benefit as a 371 U.S. National Stage Application from International Application No. PCT/EP2006/003435 filed Apr. 13, 2006 which claims the benefit of DE 10 2005 025 660.0 filed Jun. 3, 2005, the entire disclosures of the applications being considered part of the disclosure of this application, and hereby incorporated by reference.

FIELD OF THE INVENTION

The invention relates generally to metal forming and more particularly to a device and method for explosive forming of tubular work pieces.

BACKGROUND OF THE INVENTION

Different devices and methods exist for forming of a work piece. During hydroforming, for example, a tubular work piece is filled with a liquid, generally water, and sealed. By increasing the liquid pressure, the work piece is widened and gradually comes against the contours of the forming guide surrounding the work piece. In this method, relatively high forces must be applied to deform the work piece and to keep the forming die applied over a longer period. In order to obtain good results, the trend of the forces, over time, must be precisely controlled.

Hydroforming can also be operated by explosion energy. This widespread method utilizes a liquid, like water, as transfer medium for the pressure waves formed by the explosion. The work piece, generally a sheet metal plate, is positioned on the cavity of a mold and lowered into a water bath. A vacuum is generally created in the cavity beneath the work piece. By introduction of an explosive charge into the water bath and then ignition, the sheet metal plate is forced into the mold and thus acquires its final shape. This method is used, for example, in shipbuilding. It is generally used to produce flat objects to be formed from a flat plate.

An explosive forming method of the generic type just mentioned without liquid is described in EP 592 068. To produce a camshaft, a lower mold half is equipped with the already prefabricated cam. After a camshaft, hollow on the inside, has been introduced through the openings of the individual cams, the upper mold half is placed on the lower one. The individual cams are separately supported by holding arms guided through special openings in the die halves. The ends of the closed mold are sealed by sealing elements running radially to the camshaft through the side walls of the die. A plug-like spark plug, extending into the camshaft, is screwed through one of these end plates. After the shaft has been filled with combustible gas, it is ignited by means of the spark plug. Because of the abrupt increase in gas pressure in the interior of the shaft, it is widened and forced into the openings of the individual cams. These are therefore connected axially and splined to the camshaft.

This method, although it gets by without any liquid, is relatively complicated and time-consuming to handle. The mold must be initially pre-equipped with finished parts and the camshaft then threaded with precise fit through the openings of the individual cams. The side surfaces must then be applied with precise fit and mounted. Feed lines for the gas must be provided, as well as a spark plug. All these are time-intensive individual working steps. The end plates or side surfaces must be resealed either during each deformation process or provided with a sealing element. However, the latter is a part subject to wear, which causes additional costs. This complicated handling results in high time expenditure and therefore costs. This method, consequently, has not gained acceptance industrially.

It would be desirable to provide a method and device that overcome at least some of the disadvantages of the prior art.

SUMMARY OF THE INVENTION

According to an aspect of at least one embodiment of the instant invention, a device for explosive forming of a tubular work piece is provided, the device comprising: a multipart explosive forming die that is operable between an opened state and a closed state, the explosive forming die when in the closed state defining a forming area having an inner surface corresponding to a final shape of the tubular work piece and defining a nozzle arrangement adjacent to the forming area, the tubular work piece being substantially enclosed when the explosive forming die is in the closed state; and, a plug for forming a seal with a facing surface of the nozzle arrangement when the explosive forming die is in the closed state, wherein when the plug is inserted and the explosive forming die is in the closed state, an end of the work piece is deformed and is clamped between the plug and the nozzle arrangement, thereby forming the seal between the nozzle arrangement and the plug.

The explosion space is sealed by means of the plug and the work piece fixed in its position. By introducing the plug, the work piece is preferably plastically deformed and tightened between the plug and the forming die. The work piece is thus held not only in its position in the forming die, but also contributes itself to sealing of the explosion space. This process can be repeated in another forming process. With insertion of a new work piece blank and introduction of the plug in each individual forming process, a new seal is also produced. Because of this simple handling, which integrates several functions in one working step, a short cycle time and therefore cost-effective industrial production can be achieved.

It is advantageous that the free spacing between the plug and the forming die, when the plug is inserted, can be smaller than the material thickness of the work piece blank. By inserting the plug, the work piece is deformed and the explosion space sealed off. At the same time, the work piece is tightened between the plug and the forming die and fixed in its position.

The forming die can have a forming area that defines a final die shape, a well as at least one work piece holding area that holds the work piece. Because of this, the holding area can be aligned for tightening and fastening of the work piece, while the forming area is entirely aligned to good shaping of the work piece. The separate holding area can later be readily separated from the finished part.

The cavity of the forming die can be designed conically in the work piece holding area. The conical shape permits easier introduction of the plug, as well as easier loosening of the plug after the forming process.

The plug can advantageously be designed on its front end facing the work piece according to the work piece holding area of the forming die. If the plug represents essentially an impression of the work piece holding area, good sealing can be achieved during introduction of the plug.

The plug can produce a connection of the explosion space in the interior of the forming die with a gas feed device, venting device and/or ignition device. By integration of several functions in an already present component, namely, the plug, the handling capability of the device is simplified. By introducing the plug, the work piece can thus not only be sealed and simultaneously fixed, but also, for example, connected to a gas feed.

A separation edge can be provided in the forming die between a forming area that defines the final die shape and a work piece holding area that holds the work piece. Because of this, the deformed work piece holding area is already separated from the finally formed work piece during the forming process.

At least one piercing die to produce a hole in the work piece can advantageously be provided in the forming die. The work piece is provided with holes during the forming process on this account. Because of the high temperatures and flow rates prevailing during explosive forming, the hole edges have high quality and are generally already free of burrs.

In one embodiment of the invention, an ejection mechanism for the separated hole material can be provided in the area of the hole base of the piercing die. Through this mechanism, the separated material can be eliminated simply and in time-saving fashion from the forming die.

At least one cutting die to cut the work piece can advantageously be provided in the forming die. Cutting of the work piece simultaneously occurs with forming.

The invention may include a nozzle arrangement, comprising several forming die parts and forming the access to a forming area of the forming die, can be enclosed by a collar in the closed state. The individual forming die parts, which naturally tend to separate because of the explosion forces, are enclosed by the collar and kept together. This sensitive site is additionally secured on this account.

The section of the nozzle arrangement encompassed by the collar can have a work piece holding area. The work piece holding area exposed to high forces is therefore enclosed and held together on this account.

In an advantageous embodiment, the collar can be designed in one piece with the plug. The one-piece shape guarantees good holding together between the plug and collar, and the enclosure to be achieved with the collar can be controlled, together with movement of the plug.

A force coupling mechanism may be provided, which reverses at least part of the forces forming by the explosion in a direction in which the plug is forced onto the forming die. The forces that form by the explosion and actually drive the device apart are thus diverted and utilized to press on the plug and therefore seal the device.

A force coupling mechanism can advantageously be provided, which deflects at least part of the forces forming by the explosion in a direction, in which a collar is forced into a position enclosing a nozzle arrangement of the forming die. The forces forming through the explosion that drive the forming die apart can thus be deflected into forces that hold the forming die together.

An engagement element of the forming die and an ignition tube can be guided on a movement path in a movable control element, in which the movement path of the engagement element is arrangement roughly parallel to the movement direction of the control element and the movement path of the ignition tube across this direction. Through this arrangement of the movement paths, the ignition tube can be moved independently of the engagement element by means of a control element. Force coupling between the engagement element and the ignition tube is therefore provided.

The movement paths can advantageously be designed as grooves in the control element, in which a shoulder of the engagement element or ignition tube engages. The grooves guarantee good and close guiding and permit force transfer in two directions, because of their two contact edges.

In another embodiment of the invention, a deflection mechanism can be provided, through which an ignition tube can be moved by means of a movement path between a working position, in which the ignition tube is forced against the forming die, and a rest position at a spacing from the forming die. The ignition tube can be controlled between its two end positions via the deflection mechanism.

The ignition tube can be moved between the working position and the rest position by movement of a control element coupled to the ignition tube via the movement path of the deflection mechanism. Through this deflection mechanism, the movement or driving force of the control element is converted to a driving force or movement of the ignition tube. Via the design of the movement path, a transmission ratio for the force or movement of the individual components can therefore be adjusted relative to each other. Depending on the layout of the movement path of the deflection mechanism, the inertia of the control element can contribute to a better absorption of the brief high explosion forces.

The ratio of the force to be applied to operate the deflection mechanism to the resulting force that moves the ignition tube can advantageously be 3-5:1, especially 3.5-4.5:1, and, in particular, 4:1. This is a favorable force ratio, in order to also keep the ignition tube in its position during the explosion.

The movement path can be arranged running across the movement direction of the ignition tube. Because of this, good transmission of the force or movement of the control element to the force or movement of the ignition tube is provided. Compensation of brief force peaks, as they occur during an explosion, can be favorably influenced by the trend of the movement path.

The movement path can be sloped about 60° to 85°, especially 75° to 80°, and, in particular, about 77°, relative to the movement direction of the ignition tube. This guarantees a favorable force ratio, in order to trap brief high force peaks and thus keep the ignition tube in the desired position even during the explosion. Depending on the slope of the movement path, the inertia of the control element also contributes to this task.

The ignition tube can advantageously carry a plug on its front end facing the forming die. The plug, together with the ignition tube, is therefore moved and forced against the forming die in sealing fashion in the working position of the ignition tube.

The ignition tube can carry a collar on its front end facing the forming die, which encloses a nozzle arrangement of the forming die. The collar is thus moved by the ignition tube movement and forced into a position that encloses the nozzle arrangement in the working position of the ignition tube.

The ignition tube can advantageously be guided in a groove forming a movement path. The groove guarantees close and precise guiding, as well as force and movement transmission in two directions through the two contact edges.

According to an aspect of the present invention, an explosion forming method for a tubular work piece, comprising: inserting the tubular work piece into a multipart, opened forming die; closing the forming die so as to substantially enclose the tubular work piece within a die cavity of the forming die; inserting a plug so as to press on an end of the tubular work piece that is accessible from outside of the forming die, thereby forming a seal by deforming and clamping the end of the tubular work piece between the plug and the forming die; and, explosion forming the tubular work piece to conform to a shape of the die cavity, wherein the die cavity has a shape that corresponds to a final shape of the tubular work piece after the explosion forming.

In only one working step, namely, introduction of the plug, the explosion space is sealed and the work piece simultaneously tightened and fixed in the mold. By integration of several functions and therefore individual working steps in one working step, the cycle time of an individual explosion forming process can be reduced and an industrially favorable method therefore generated.

An end area of the work piece accessible from the outside can be conically deformed by introduction of the plug. By deforming the end area of the work piece, this is fixed in the mold. The conical form guarantees easy introduction and removal of the plug.

An end area of the work piece accessible from the outside can be forced into ribs provided in a work piece holding area of the forming die by introduction of the plug. Pressing into the holding ribs guarantees good fastening of the work piece, as well as sealing of the explosion space.

A connection of the explosion spaces to a gas feed device, venting device and/or ignition device can advantageously be produced by introduction of the plug. By integration of these functions and individual working steps in the working step "introduce plug," the cycle time can be reduced and the process simplified.

A collar can be applied when the die mold is closed onto a nozzle arrangement comprising several forming die parts that forms the access to a forming area of the forming die, in which the collar encloses the nozzle arrangement. The individual forming die parts are enclosed by the collar in the area of the nozzle arrangement and held together during the explosion process.

At least part of the explosion forces acting on the forming die can be advantageously diverted and force the plug against the nozzle arrangement, which forms the access to a forming area of the forming die. The explosion forces that drive the device apart are deflected on this account and used to force the plug against the nozzle arrangement, in order to therefore seal the explosion space.

At least part of the explosion forces acting on the forming die are diverted and force a collar into a position that encloses the nozzle arrangement of the forming die. The explosion forces that drive the forming die apart are thus diverted and used to hold it together.

An ignition tube can advantageously be moved by means of a movement path between a working position, in which the ignition tube is forced against a nozzle arrangement of the forming die, which forms the access to a forming area of the forming die, and a rest position at a spacing from the forming die. By the movement of the movement path, the movement of the ignition tube is therefore initiated and controlled.

An engagement element of the forming die, movable with the forming die and the ignition tube, can be guided by means of a movable control element for each movement path and during movement of the control element, the ignition tube is moved between the working position and the rest position, while the engagement element stands still. The ignition tube and the engagement element of the forming die are force-fit via the control element. The ignition tube can be moved and controlled independently of the engagement element by movement of the control element.

The explosion space can advantageously be filled with oxyhydrogen gas in a roughly stoichiometric mixture with a slight $O_2$ excess. The slight oxygen excess guarantees complete reaction of hydrogen. The forming die can be opened without hazard, since no free oxygen is present.

The work piece can be cut during explosive forming. By integration of the cutting process in the forming process, the production time of the entire product is shortened.

The deformed holding area of the work piece can advantageously be separated from the finished molded part during explosive forming. Certain cutting processes can therefore already be integrated in the step of explosive forming.

The work piece can be provided with at least one hole during explosive forming. Integration of an additional work step, namely, perforation, in the actual forming process reduces the final machining time and therefore the overall machining time of the work piece. The separated hole material can be discarded. This simplifies and accelerates work piece change.

BRIEF DESCRIPTION OF THE DRAWINGS

The invention is described below with reference to the following drawings, and wherein.

DETAILED DESCRIPTION OF EMBODIMENTS OF THE INSTANT INVENTION

Figure 1:
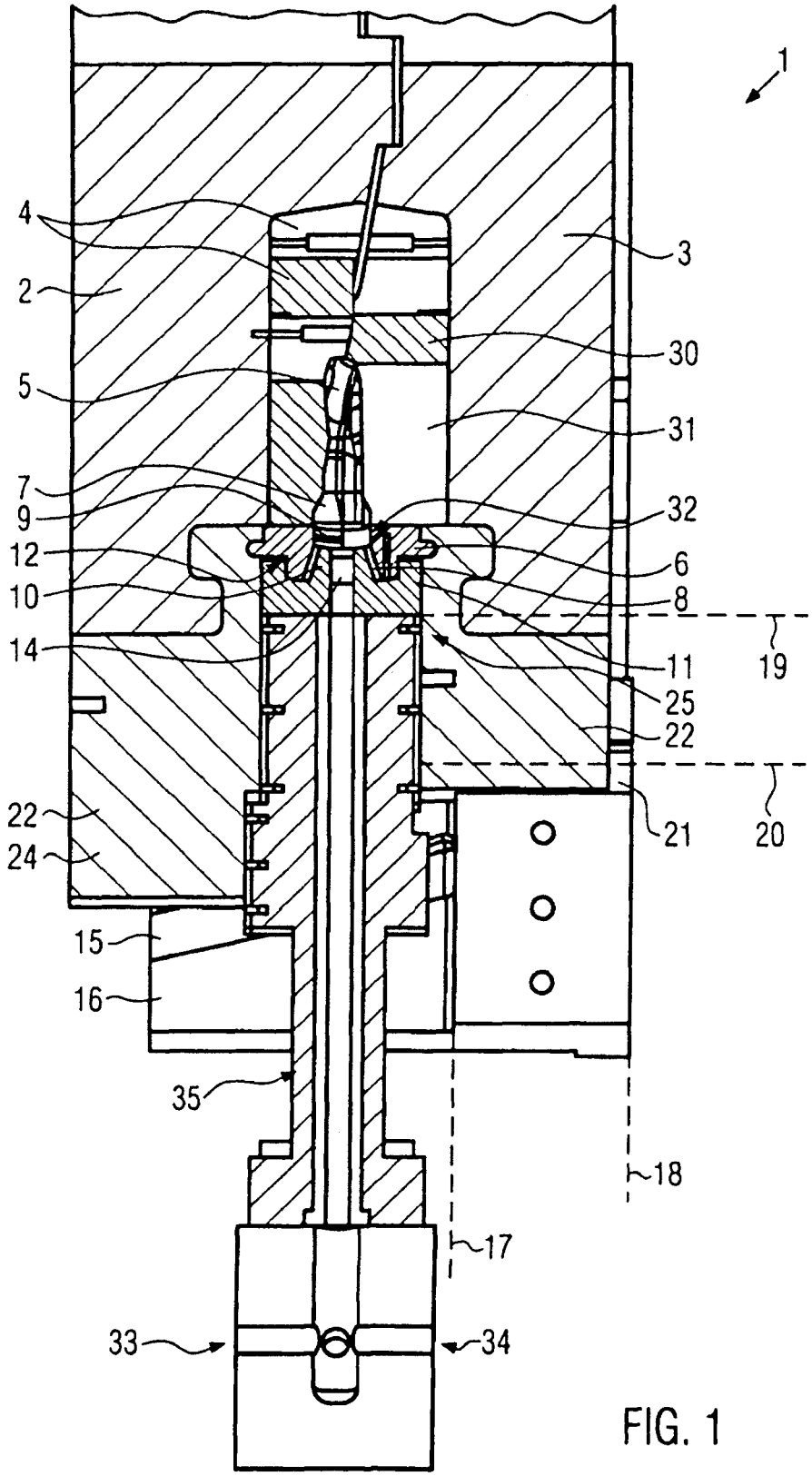
FIG. 1 shows a vertical section through the device along section I-I from FIG. 4.

FIG. 1 shows a vertical section through the device. The multipart forming die 1 here is shown in the closed state and consists in this practical example of an upper 2 and lower 3 forming die half. The actual die mold or contour is produced by the die inserts 4, which are inserted in the upper 2 and lower 3 forming die halves and mechanically connected to them. The die contour, however, can also be introduced directly into the upper 2 and lower 3 forming die halves. In the closed state, the mold halves form a die cavity 5 in their interior that corresponds to the final shape of the work piece after the forming process.

In order for the work piece to come in contact with die cavity 5 during the forming process, the forming die 1 is provided with venting openings (not shown). These are preferably arranged gap-like along the die contour. The air contained in the die cavity 5 can thus escape and not hamper the work piece in its expansion. In addition, a more uniform temperature distribution during forming is guaranteed. The not illustrated openings have a limited width, which is roughly equal to or less than the wall thickness of the work piece, so that the work piece is not forced into the openings.

At the location of the die inserts 4, one or more piercing dies 30 and/or cutting dies 31 can also be inserted into the forming die. As an alternative, the perforation or cutting edges can also be introduced directly into the upper 2 or lower 3 forming die halves. The work piece can thus be provided with holes and/or cut already during the forming process. The piercing dies have an ejection mechanism (not shown) close to the base of the hole for the separated hole material. By automatic ejection of the waste material, the forming die is again made ready for use after the forming process.

The forming die in this practical example has a nozzle arrangement 6, accessible from the outside and consisting of several forming die parts. It forms during closure of the multipart forming die 1 by engagement of the shapes in the individual forming die parts 2, 3, whose interfaces come to line one on the other. The nozzle arrangement 6 forms the access to a forming area 7 of forming die 1 that defines the final work piece shape. In this practical example, the nozzle arrangement 6 also includes a work piece holding area 8, which is formed conically here and provided with holding ribs 9.

During the explosive forming process, an explosion space within the work piece is closed by a plug 10 inserted into the nozzle arrangement 6 and forced against the work piece holding area. The slight distance between the work piece holding area 8 and the plug 10 is then less than the material thickness of a work piece blank. The end of the work piece blank is thus tightened between the plug 10 and the work piece holding area 8. During insertion of the plug 10, the work piece in this practical example is also widened conically and forced into the holding ribs 9. Because of this, the work piece is fixed in shape, and also achieves sealing of the explosion space within the work piece.

A separation edge 32 is provided between the work piece holding area 8 and the forming area 7 of forming die 1 by means of a die insert 4 or directly in the forming die halves 2, 3. During the forming process, this edge separates the deformed holding area of the work piece from the finished molded article.

In order to additionally secure the nozzle arrangement 6, which is exposed to particular loads, because of the numerous interfaces and the plug 10 forced against it, a collar 11 is provided. The collar 11 in this practical example is designed in one piece with plug 10 for stability reasons. During the forming process, the collar 11 engages in an annular recess 12 of the nozzle arrangement 6 and encloses it in annular fashion.

The collar 11 and the plug 10 are provided on a front end of the ignition tube 13 facing the die. The plug in this practical example is provided with a central hole 14 and thus connects the explosion space in the interior of the work piece via the ignition tube 13 to a gas feed 33, venting 34, and ignition device 35. The ignition device 35 can then be integrated, as here, in the ignition tube 13. As an alternative, the plug can serve merely as a closure element or form the connection to only one of the mentioned devices.

Figure 2:
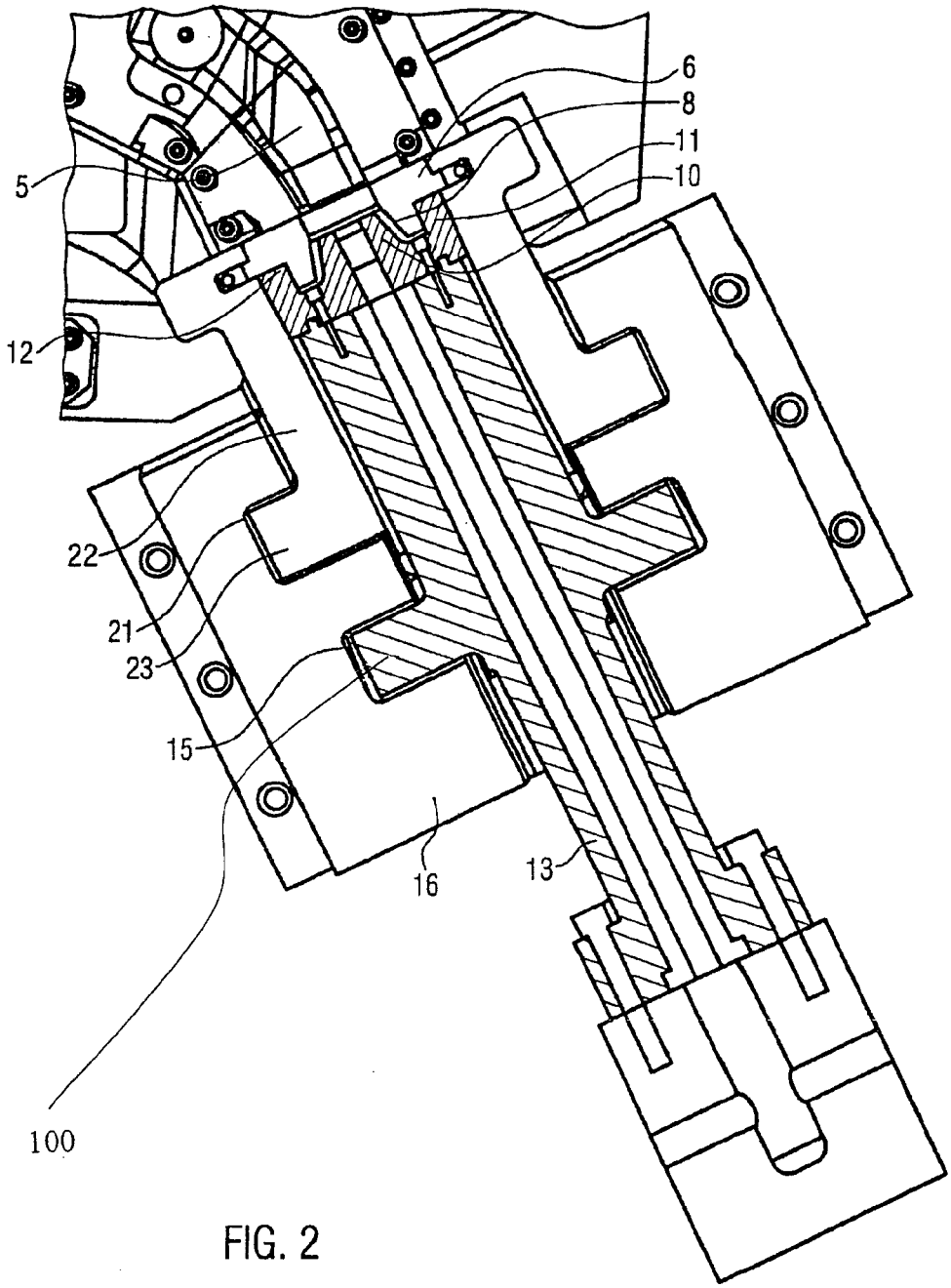
FIG. 2 shows a horizontal section through the device along section II-II in FIG. 3.

The ignition tube 13 in this practical example is guided via a shoulder 100 shown in FIG. 2 in a groove 15 in a control element 16. As an alternative, the ignition tube could also be guided by another mechanism on the movement path stipulated by groove 15. The control element 16 here can be moved vertically relative to ignition tube 13 between an upper 17 and lower 18 end position. Vertical movement of the control element 16 can be converted via the groove 15 into a horizontal movement of ignition tube 13. By movement of control element 16, the ignition tube can be moved between a working position 19, in which the ignition tube 13 and therefore plug 10 and collar 11 are forced against forming die 1, at a rest position 20 at a spacing from the forming die 1.

In the control element 16 in this practical example, there is an additional groove 21, in addition to the first groove 15, in which an engagement element 22 of the forming die 1 engages via a shoulder 23 depicted in FIG. 2. The engagement element 22 is also divided in two, like the forming die 1, in which the upper half 24 of the engagement element is connected to the upper forming die half 2 and is opened and closed together with it. Groove 21, via which the engagement element 22 is connected to control element 16, runs parallel to the movement direction of control element 16. Because of this, a movement of control element 16 is not affected by the engagement element 22 in any way, in contrast to ignition tube 13, and also the engagement element 22 can be opened and closed together with the upper forming die half 2 without an influence on control element 16 or ignition tube 13.

Since the control element 16 connects the ignition tube 13 to engagement element 22 in force-fit, the interaction between these three components acts as a force coupling mechanism for the forces developing during the explosive forming process. Those explosion forces that act in the movement direction of ignition tube 13 are taken up via engagement element 22 of forming die 1 and diverted in the opposite direction by means of grooves 15, 21 via control element 16. The explosion forces, which originally cause separation of the device and recoil of ignition tube 13, are used to force the ignition tube 13 and therefore plug 10 and collar 11 on its front end 25 back against forming die 1. Part of the explosion forces are therefore utilized to seal and secure the forming die.

Figure 3:
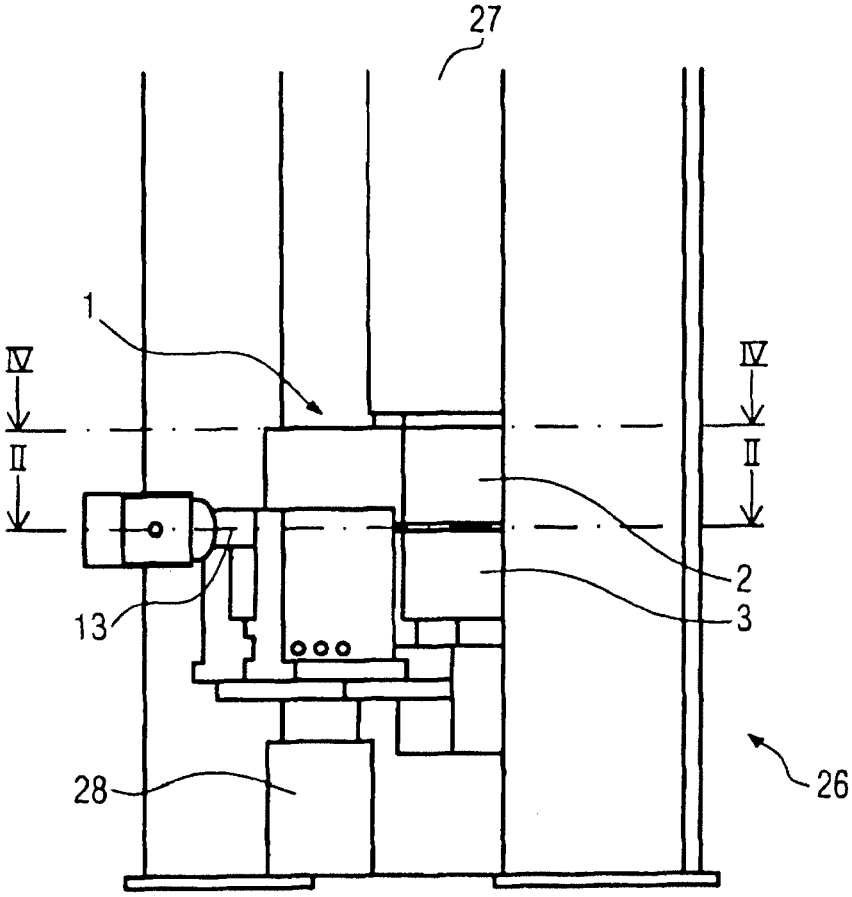
FIG. 3 shows a slightly oblique side view of the device arranged in a press.

FIG. 3 shows the device for explosive forming arranged in a press 26. The reference numbers used in FIGS. 1 and 2 refer to the same parts as in FIG. 3, so that the description of FIGS. 1 and 2 is referred to in this respect. The two forming die halves 2, 3 are pressed together by the hydraulic cylinder 27 of the press 26. The holding forces in this forming process with the depicted device are only about one-fourth of the holding forces of a comparable process during hydroforming.

The control element 16 in this practical example is moved by means of a hydraulic cylinder 27 between its end positions 17, 18, depicted in FIG. 1. By lifting the control element 16, this is brought into its upper end position 17, in which a lower edge of the control element 16 roughly coincides with the plane 17, shown with the dashed line in FIG. 2. By movement of the control element 16 into its upper end position 17, the ignition tube 13 is also brought into its working position 19, in which the plug 10 is forced on its front end 25 against nozzle arrangement 6. The pressure applied by the hydraulic cylinder is then about 400 tons. This is transformed by means of groove 15 into about 100 tons pressure of ignition tube 13 and plug 10 on nozzle 6. This force ratio can be achieved with a groove 15 sloped by about 77° relative to the movement direction of ignition tube 13 and guarantees good trapping of brief high force peaks that occur during an explosion. The inertial forces of control element 16 also contribute to trapping brief force peaks. By lowering control element 16 by means of hydraulic cylinder 27, this is brought into its lower end position 18, in which the lower edge of control element 16 roughly coincides with the plane 19, depicted with the dashed line in FIG. 2. In this position of control element 16, the ignition tube 13 is in its rest position 20.

Figure 4:
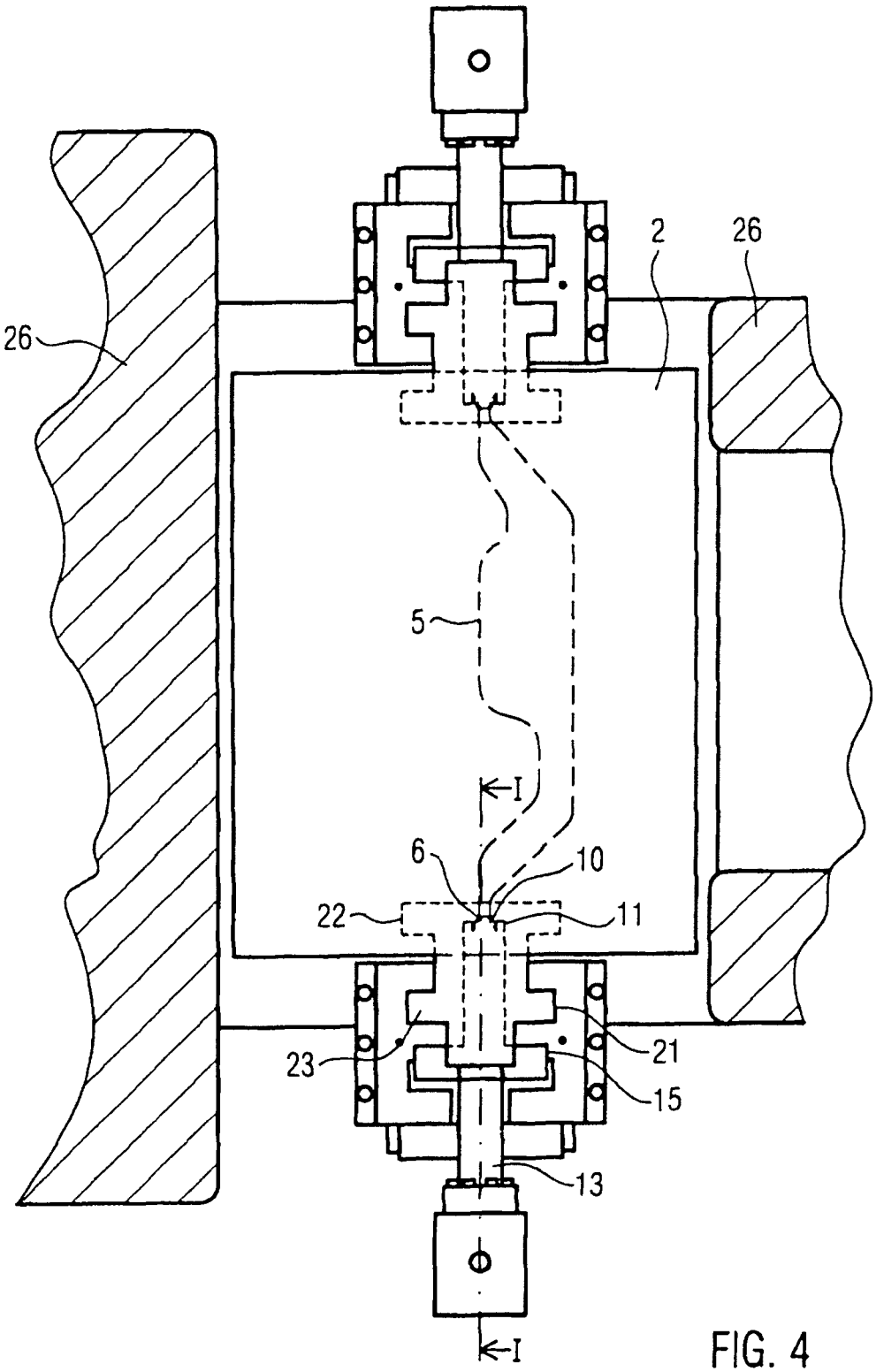
FIG. 4 shows a top view of the forming die in the press along section IV-IV in FIG. 3.
Figure 5:
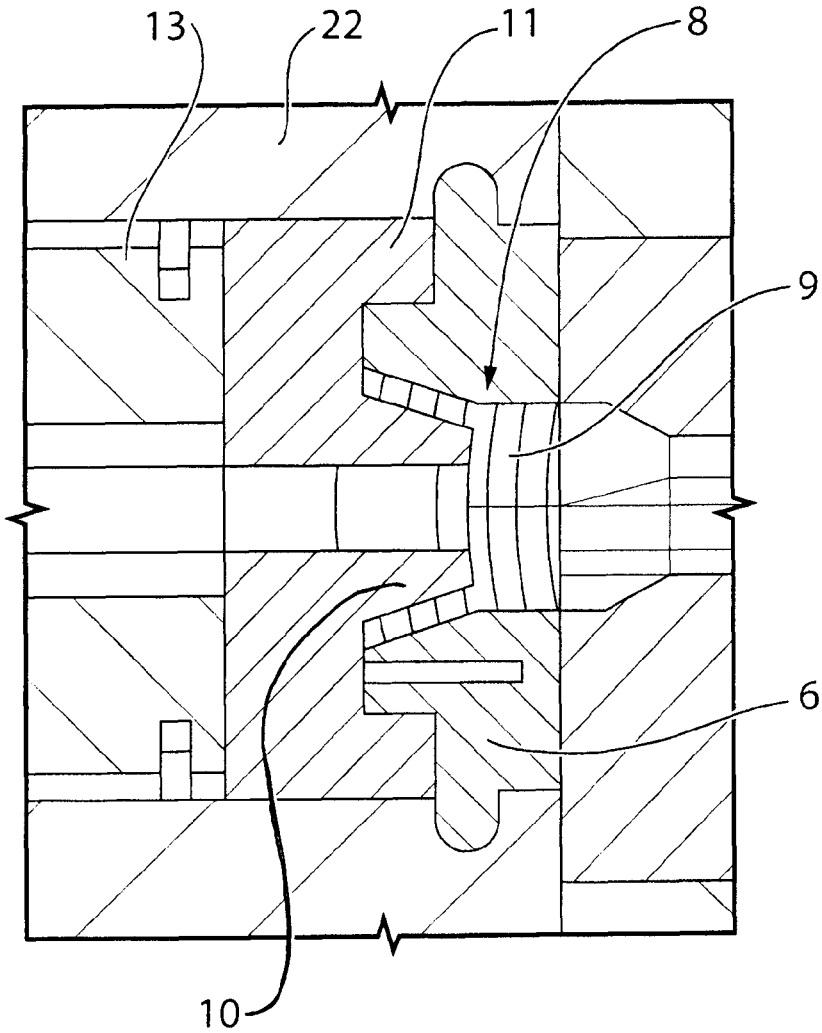
FIG. 5 shows enlarged detail of the work piece holding area of FIG. 1.

FIG. 4 shows section Iv-Iv through the press depicted in FIG. 3. The reference numbers used in FIGS. 1 to 3 refer to the same parts as in FIG. 4, so that the description in FIGS. 1 to 3 is referred to in this respect.

FIG. 4 shows a top view of the upper forming die halves 2 in the closed forming die 1. The component contours covered by the upper forming die halves 2 or otherwise are shown with dashed lines here. The die cavity 5 in the interior of forming die 1 is shown with a dash-dot line.

A method for explosive forming with the device depicted in the practical example according to the invention is explained below.

Initially, a tubular work piece blank is inserted into the lower forming die half 3. The forming die is then closed by applying the upper die half 2. The work piece is almost fully enclosed on this account. Only the two work piece ends remain accessible from the outside. The method for closure of the work piece ends is explained below by means of one work piece end.

The ignition tube 13, which carries the plug 10 and collar 11 on its front end 25, is moved from its rest position 20 to its working position 19 by movement of control element 16. Because of this, the plug 10 is forced into the end area of the work piece, so that the work piece at this location is deformed conically and forced into the holding ribs 9 of work piece holding area 8. Because of this, a tight connection is produced between plug 10 and forming die 1 and the work piece is fastened in the die mold. With introduction of the plug, a connection to a gas feed 33, venting 34 and ignition device 35 is simultaneously produced.

By movement of the ignition tube 13, the collar 11 is simultaneously applied to nozzle arrangement 6. This encloses the nozzle arrangement in annular fashion and secures it against separation of the individual forming die parts during the forming process.

By closure of forming die 1, the engagement element 22 connected to the upper forming die half 2 is brought into engagement with groove 21 in control element 16. The ignition tube 13, also connected to control element 16 via groove 15, is connected force-fit to plug 10 and collar 11 on the front end 25 of ignition tube 13. Part of the forces forming during the explosion are diverted via this force coupling mechanism and used as contact force for the plug 10 and collar 11 against forming die 1.

The explosion space in the interior of the work piece is filled with oxyhydrogen gas in a stoichiometric mixture with slight oxygen excess via the ignition tube 13 and plug 10. The gas is then ignited by an ignition device 35 arranged in the ignition tube 13, so that the work piece is forced into die cavity 5. At the same time, the work piece is cut by cutting edges 30, 31 provided in forming die 1 and provided with the necessary holes. The deformed holding area of the work piece is also separated from the finished molded part. The separated hole material is ejected through a not illustrated ejection mechanism.

Alternately, cutting and/or perforation of the work piece can also occur in a separate subsequent process step. For this purpose, the work piece finished by explosion forming is removed from the die mold and introduced to another mold, in which it is provided with holes and/or cutouts and/or separated from the holding area.

After the forming process, the forming die 1 is vented via ignition tube 13 and plug 10. The ignition tube 13 is brought back to its rest position 20 by lowering of control element 16 from its work position 19. Because of this, the plug 10 and collar 11 are also removed from the forming die. The forming die can now be opened and the finished molded part removed.

What is claimed is:

1. An explosion forming method for a tubular work piece, comprising:

inserting the tubular work piece into a multipart, opened forming die (1);

closing the forming die (1) so as to substantially enclose the tubular work piece within a die cavity (5) of the forming die (1);

inserting a plug (10) so as to press on an end of the tubular work piece that is accessible from outside of the forming die (1), thereby forming a seal by deforming and clamping the end of the tubular work piece between the plug (10) and the forming die (1);

positioning a collar (11) in the closed die mold (1) so as to enclose a portion of a nozzle arrangement (6) of the multipart forming die (1);

explosion forming the tubular work piece to conform to a shape of the die cavity (5), wherein the die cavity (5) has a shape that corresponds to a final shape of the tubular work piece after the explosion forming; and diverting at least part of the forces that are formed by an explosion, during the explosion forming of the tubular work piece, along a direction in which the plug (10) is pressed against the nozzle arrangement (6) of the forming die (1).

2. The method according to claim 1, comprising diverting at least part of the forces that are formed by an explosion, during explosion forming of the tubular work piece, along a direction in which the collar (11) is pressed into a position that encloses the portion of the nozzle arrangement (6) of the forming die (1).

3. An explosion forming method for a tubular work piece, comprising:

inserting the tubular work piece into a multipart, opened forming die (1);

closing the forming die (1) so as to substantially enclose the tubular work piece within a die cavity (5) of the forming die (1);

inserting a plug (10) so as to press on an end of the tubular work piece that is accessible from outside of the forming die (1), thereby forming a seal by deforming and clamping the end of the tubular work piece between the plug (10) and the forming die (1) and wherein the plug (1) presses the end area of the work piece into ribs (9) that are provided in a work piece holding area (8) of forming die (1); and explosion forming the tubular work piece to conform to a shape of the die cavity (5), wherein the die cavity (5) has a shape that corresponds to a final shape of the tubular work piece after the explosion forming.

4. An explosion forming method for a tubular work piece, comprising:

inserting the tubular work piece into a multipart, opened forming die (1);

closing the forming die (1) so as to substantially enclose the tubular work piece within a die cavity (5) of the forming die (1);

inserting a plug (10) so as to press on an end of the tubular work piece that is accessible from outside of the forming die (1), thereby forming a seal by deforming and clamping the end of the tubular work piece between the plug (10) and the forming die (1); wherein introduction of the plug (10) provides a connection for providing fluid communication between an explosion space within the forming die (1) and at least one of a gas feed device, a venting device, and an ignition device; and explosion forming the tubular work piece to conform to a shape of the die cavity (5), wherein the die cavity (5) has a shape that corresponds to a final shape of the tubular work piece after the explosion forming.

5. The method according to claim 4, comprising introducing into the explosion space an oxyhydrogen gas in an approximately stoichiometric mixture with a slight O2 excess.

6. The method according to claim 4, wherein the tubular work piece is cut during explosive forming.

7. The method according to claim 4, wherein the deformed end of the tubular work piece is separated during explosive forming.

8. The method according to claim 4, comprising forming at least one hole in the tubular work piece during explosive forming.

9. The method according to claim 8 wherein said step of forming at least one hole include the step of ejecting any separated hole material.

10. An explosion forming method for a tubular work piece, comprising:

inserting the tubular work piece into a multipart, opened forming die (1);

closing the forming die (1) so as to substantially enclose the tubular work piece within a die cavity (5) of the forming die (1);

inserting a plug (10) so as to press on an end of the tubular work piece that is accessible from outside of the forming die (1), thereby forming a seal by deforming and clamping the end of the tubular work piece between the plug (10) and the forming die (1);

moving an ignition tube (13) along a movement path between a working position (19), in which the ignition tube (13) presses the plug (10) against a facing surface of a nozzle arrangement (6) of forming die (1), and a rest position (20) in which the ignition tube (13) is spaced apart from the nozzle arrangement (6) of the forming die (1); and explosion forming the tubular work piece to conform to a shape of the die cavity (5), wherein the die cavity (5) has a shape that corresponds to a final shape of the tubular work piece after the explosion forming.

11. The method according to claim 10, wherein an engagement element (22) of the forming die (1), which is movable with the forming die (1), and the ignition tube (13) are guided by a path of a movable control element (16), and during movement of the control element (16) the ignition tube (13) is moved between the working position (19) and the rest position (20), while the position of the engagement element (22) is substantially unchanged.

* * * * *